US006750432B2

(12) United States Patent
Yamanoi

(10) Patent No.: US 6,750,432 B2
(45) Date of Patent: Jun. 15, 2004

(54) HEAT ROLLER CONTROL APPARATUS WITH ROLLER SURFACE TEMPERATURE VARIATIONS DETERMINATION

(75) Inventor: Masaru Yamanoi, Gunma (JP)

(73) Assignee: Japan Servo Co., Ltd., Tokyo (JP)

( * ) Notice: Subject to any disclaimer, the term of this patent is extended or adjusted under 35 U.S.C. 154(b) by 75 days.

(21) Appl. No.: 10/061,042

(22) Filed: Jan. 30, 2002

(65) Prior Publication Data

US 2002/0108942 A1 Aug. 15, 2002

(30) Foreign Application Priority Data

Feb. 9, 2001 (JP) ..... 2001-033478

(51) Int. Cl.[7] ..... H05B 1/02
(52) U.S. Cl. ..... 219/497; 219/469
(58) Field of Search ..... 219/497, 494, 219/501, 469–471, 216, 388, 244; 156/359

(56) References Cited

U.S. PATENT DOCUMENTS

| | | | | |
|---|---|---|---|---|
| 4,868,368 A | * | 9/1989 | Araki | 219/216 |
| 5,140,132 A | * | 8/1992 | Shiokawa | 219/216 |
| 5,365,314 A | * | 11/1994 | Okuda et al. | 399/69 |
| 5,436,431 A | * | 7/1995 | Tsuji et al. | 219/216 |
| 5,798,501 A | * | 8/1998 | Yamane | 219/497 |

FOREIGN PATENT DOCUMENTS

| | | | |
|---|---|---|---|
| JP | 61-11778 | * | 1/1986 |
| JP | 62-234179 | * | 10/1987 |
| JP | 2-10414 | * | 1/1990 |
| JP | 9-185276 | * | 7/1997 |
| JP | 9-311581 | * | 12/1997 |
| JP | 10-187254 | * | 7/1998 |
| JP | 10-232581 | * | 9/1998 |
| JP | 11-143283 | * | 5/1999 |
| JP | 2000-95216 | * | 4/2000 |

* cited by examiner

*Primary Examiner*—John A. Jeffery
(74) *Attorney, Agent, or Firm*—Boyle Fredrickson Newholm Stein & Gratz S.C.

(57) ABSTRACT

A heat roller control apparatus having a heat roller for hot melt coating a thin film on a member, a heater for heating the heat roller, temperature detecting member for detecting the surface temperature of the heat roller, temperature control member for controlling the heater according to a temperature detecting signal obtained from the temperature detecting means, and temperature judging member for producing a temperature judging signal for judging the state of the surface temperature of the heat roller according to the temperature detecting signal. The temperature judging member calculates a variation of the surface temperature of the heat roller from the temperature detecting signal every predetermined time and judging the stability of the hot melt coating by the variation of the surface temperature of the heat roller when the temperature detecting signal reaches into a predetermined temperature range.

3 Claims, 4 Drawing Sheets

PRIOR ART

PRIOR ART

HEAT ROLLER CONTROL APPARATUS WITH ROLLER SURFACE TEMPERATURE VARIATIONS DETERMINATION

BACKGROUND OF THE INVENTION

1. Field of the Invention

The present invention relates to a heat roller control apparatus, and more particularly relates to a control apparatus for a heat roller for use in a laminator or the like.

2. Description of the Prior Art

FIG. 3 shows a conventional heat roller control apparatus. In FIG. 3, a reference numeral 1 denotes a heat roller, 1A denotes a member, such as a PVC card to be laminated with a thin film 1B, such as a PET film, 8*a* and 8*b* denote transfer rollers for transferring the member 1A and the thin film 1B, 2*a* denotes an actuator, such as a motor for rotating the heat roller 1, 2*b* denotes an actuator, such as a motor for rotating the transfer roller 8*b*, 3*a* and 3*b* denote driving circuits for driving the actuators 2*a* and 2*b*, respectively, 4 denotes a heater for heating the heat roller 1, 5 denotes a temperature detecting element, such as a thermistor for detecting a surface temperature of the heat roller 1, 6 denotes a temperature control circuit for controlling the excitation of the heater 4, 9 denotes a temperature judging circuit formed of a microprocessor, for example, for judging whether the surface temperature of the heat roller 1 is stable in a predetermined range lower than a first reference signal c1 indicating the upper limit value, but higher than a second reference signal c2 indicating the lower limit value, 10 denotes a temperature state indicator for indicating whether the surface temperature of the heat roller 1 is stable in the predetermined range, and 7*a* and 7*b* denote detecting elements, such as photosensors for detecting the presence of the member 1A, respectively.

FIG. 4 shows a diagram for explaining the surface temperature of the heat roller 1.

In FIG. 4, a reference symbol (a) denotes the first reference signal c1 indicating the upper limit value of the predetermined range, (b) denotes the second reference signal c2 indicating the lower limit value of the predetermined range, (c) denotes a temperature signal a outputted from the temperature sensing element 5, and (d) denotes a temperature judging signal e outputted from the temperature judging circuit 9. The temperature judging circuit 9 judges whether the temperature signal a outputted from the temperature detecting element 5 is in the predetermined range and maintained continuously for a predetermined setting period of time t1. Further, the temperature judging circuit 9 outputs the temperature judging signal e of low level "L" in case that the temperature signal a outputted from the temperature detecting element 5 is out of the predetermined range, or that the temperature signal a is in the predetermined range, but is not maintained continuously for the predetermined setting period of time t1. The temperature judging circuit 9 outputs the temperature judging signal e of high level "H" in case that the temperature signal a is in the predetermined range and maintained continuously for the predetermined setting period of time t1.

The actuator 2*b* is driven by the driving circuit 3*b* when the detecting element 7*a* detects the presence of the member 1A and the driving circuit 3*b* receives a first detecting signal b1 outputted from the detecting element 7*a*. The actuator 2*b* is not driven by the driving circuit 3*b* when the temperature judging signal e is low level "L". The adhesive strength of the member 1A becomes small or the member 1A is deformed if the hot melt coating is carried out in the state that the surface temperature of the heat roller 1 is out of the predetermined range. The member 1A and the thin film 1B are transferred to the heat roller 1 by the rotation of the transfer roller 8*b* when the level of the temperature judging signal e is "H" and the actuator 2*b* is driven. The heat roller 1 is rotated when the actuator 2*a* is driven by the driving circuit 3*a* irrespective of the state of the temperature judging signal e or the first detecting signal b1 outputted from the detecting element 7*a*, so that the member 1A and the thin film 1B are held by the transfer roller 8*a* and the heat roller 1, and the hot melt coating is carried out while they are transferred. The actuator 2*b* is deenergized when the member 1A and the thin film 1B are passed through the detecting element 7*b* and the driving circuit 3*b* receives a second detecting signal b2 outputted from the detecting element 7*b*.

The transfer of the member 1A is not carried out even if the presence of the member 1A is detected and the surface temperature of the heat roller 1 is in the predetermined range because the temperature judging signal e is low level "L" until the predetermined time t1 has been passed.

Thus, the time t1 becomes an idle time.

SUMMARY OF THE INVENTION

Accordingly, it is an object of this invention to provide a heat roller control apparatus free from the above defects.

It is another object of this invention to provide a heat roller control apparatus wherein a variation of a temperature signal outputted from a temperature detecting element is detected at a predetermined interval, and a temperature judging signal of high level is produced so that a member to be laminated with a thin film is transferred for hot melt coating, if the variation of the temperature signal is smaller than a predetermined value when the temperature signal reaches in a predetermined range.

According to a heat roller control apparatus of this invention, the idle time after a surface temperature of a heat roller has reached to the predetermined temperature range can be shortened.

A heat roller control apparatus according to the present invention is characterized by comprising a heat roller for hot melt coating a thin film on a member, a heater for heating the heat roller, temperature detecting means for detecting the surface temperature of the heat roller, temperature control means for controlling the heater according to a temperature detecting signal obtained from the temperature detecting means, and temperature judging means for producing a temperature judging signal for judging the state of the surface temperature of the heat roller according to the temperature detecting signal, wherein the temperature judging means calculates a variation of the surface temperature of the heat roller from the temperature detecting signal every predetermined time and judging the stability of the hot melt coating by the variation of the surface temperature of the heat roller when the temperature detecting signal reaches into a predetermined temperature range.

A heat roller control apparatus according to the present invention is characterized by comprising a heat roller for hot melt coating a thin film on a member, a heater for heating the heat roller, temperature detecting means for detecting the surface temperature of the heat roller, temperature control means for controlling the heater according to a temperature detecting signal obtained from the temperature detecting means, and temperature judging means for producing a temperature judging signal for judging the state of the surface temperature of the heat roller according to the temperature detecting signal, wherein the member to be attached with the thin film is transferred only when the surface temperature reaches into a predetermined temperature range and a variation of the surface temperature of the heat roller is smaller than a predetermined value.

The temperature judging means is a circuit comprising an A/D converter, three comparators, an AND gate, two registers, an oscillator, a subtracter, two frequency dividers, and two inverters.

Other object and advantages will become apparent from the following description of the preferred embodiments taken in conjunction with the accompanying drawings.

DESCRIPTION OF THE PREFERRED EMBODIMENTS

Figure 1:
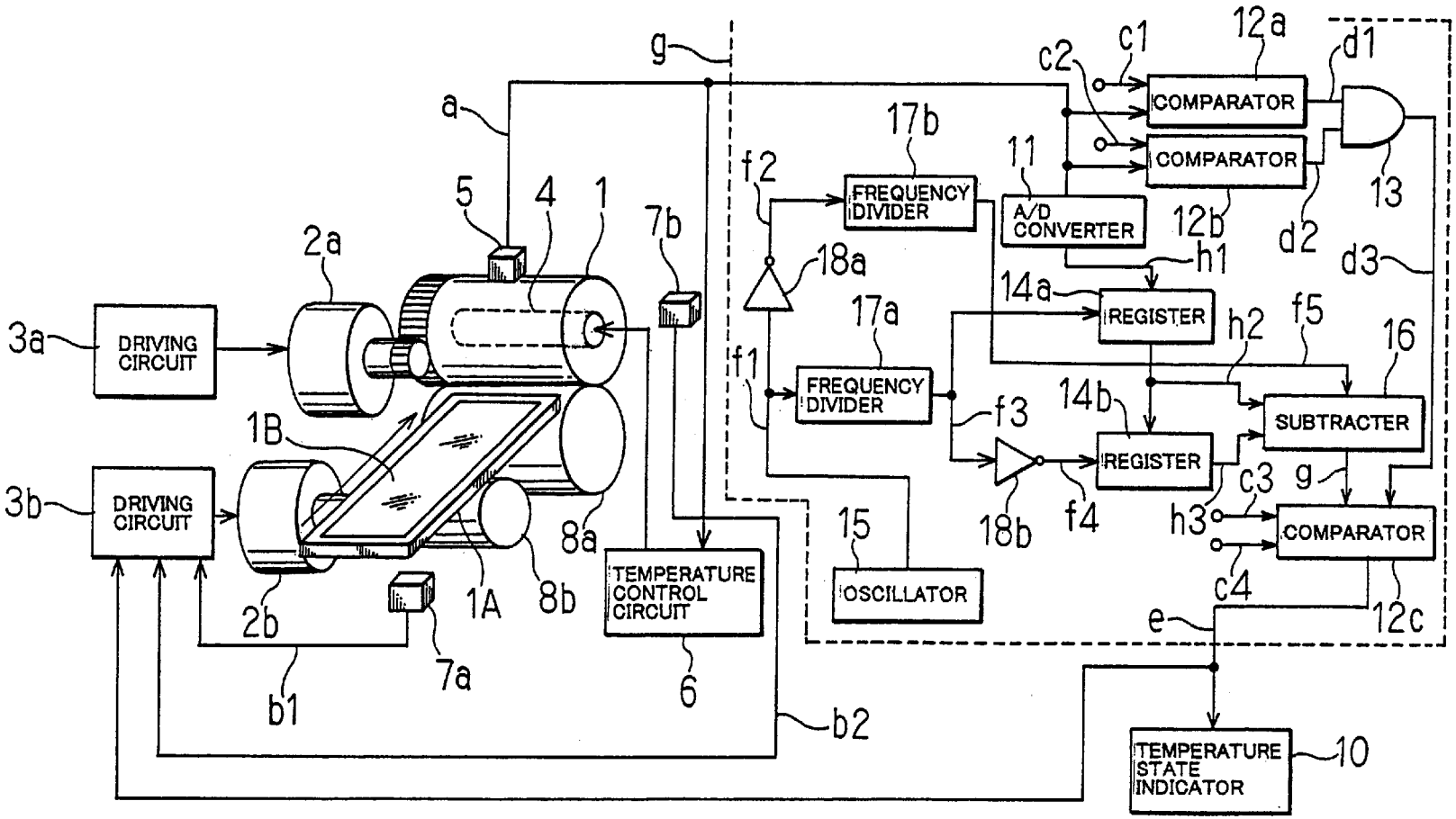
FIG. 1 is a block diagram of a heat roller control apparatus in accordance with the present invention.

FIG. 1 shows a heat roller control apparatus having a temperature judging circuit 9.

Figure 3:
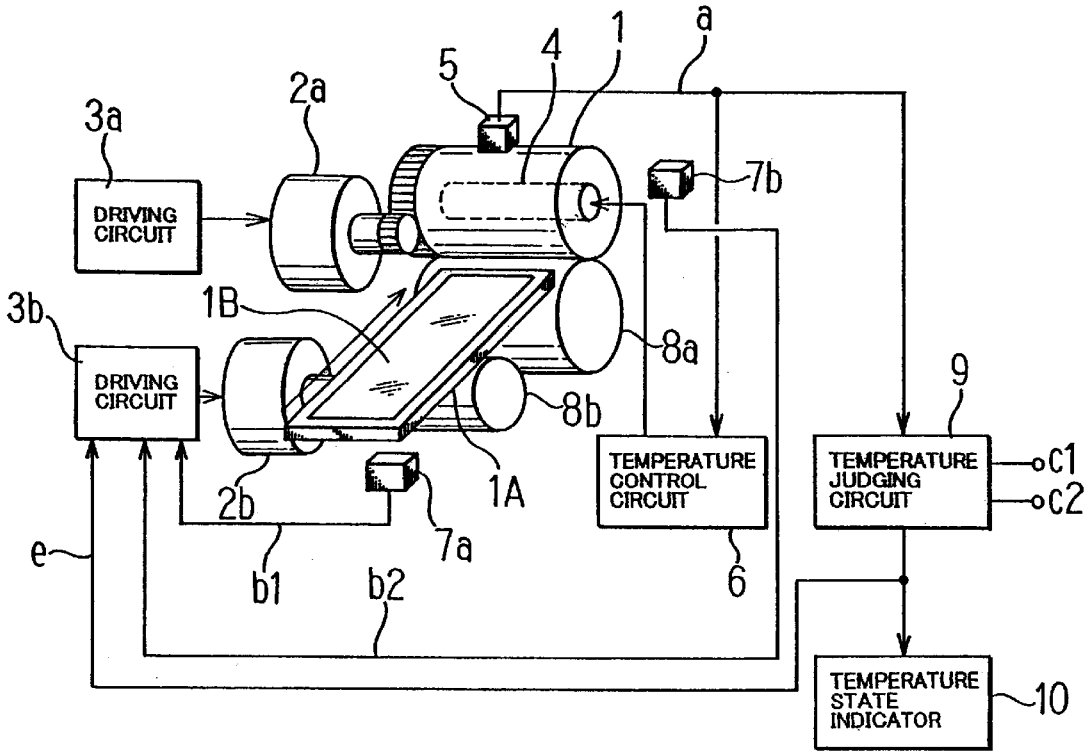
FIG. 3 is a block diagram of a conventional heat roller control apparatus.
Figure 4:
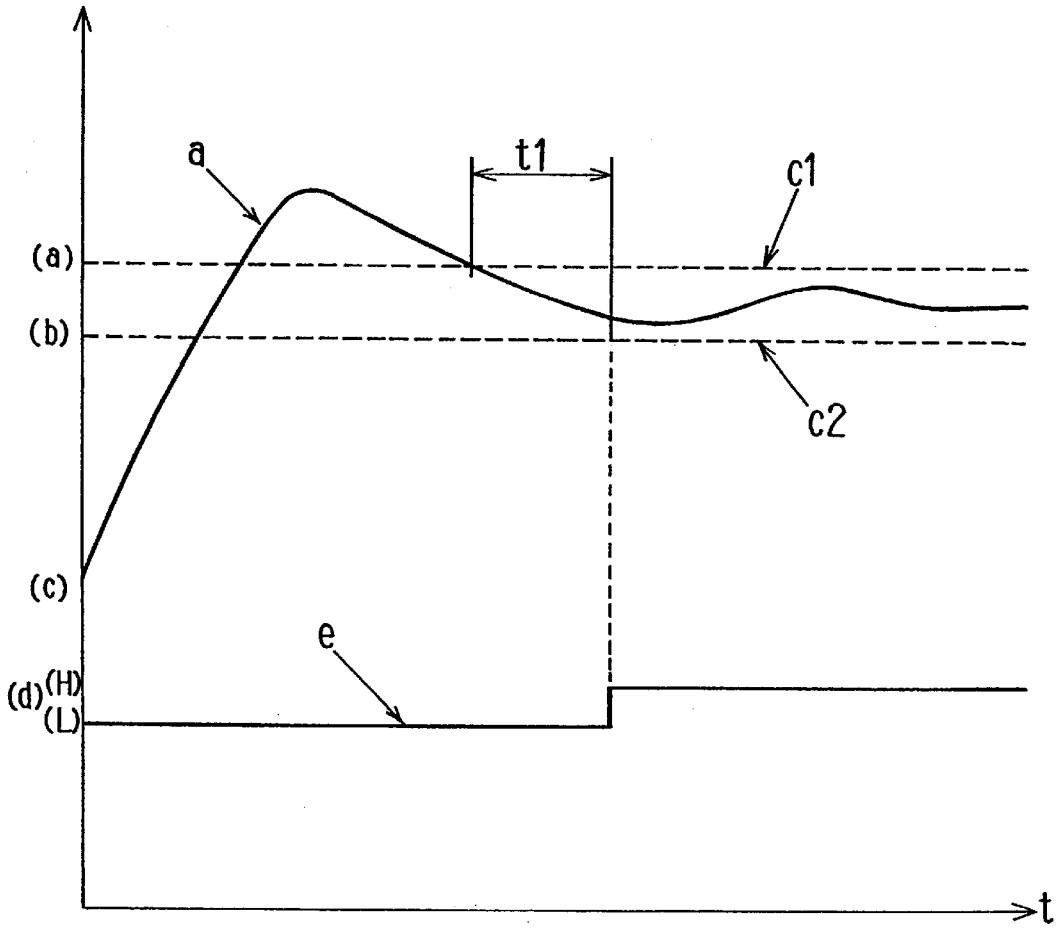
FIG. 4 shows a diagram for explaining the heat roller control apparatus shown in FIG. 3.

The parts similar to those of the apparatus shown in FIG. 3 are designated by the same reference characters.

The temperature judging circuit 9 has an A/D converter 11 for A/D converting a temperature signal a, outputted from a temperature detecting element 5, a comparator 12*a* for comparing the temperature signal a with a first reference signal c1 indicating the upper limit value of a predetermined temperature range, a comparator 12*b* for comparing the temperature signal a with a second reference signal c2 indicating the lower limit value of the predetermined temperature range, and an AND gate 13 for receiving a first comparison signal d1 outputted from the comparator 12*a* and a second comparison signal d2 outputted from the comparator 12*b* so as to generate a third comparison signal d3.

The temperature judging circuit 9 further comprises an oscillator 15 for generating a first clock signal f1, a frequency divider 17*a* for dividing the first clock signal f1 by 2 so as to generate a third clock signal f3, a register 14*a* for receiving a first temperature conversion signal h1 every time a leading edge (L→H) of the third clock signal f3 is generated and holding the first temperature conversion signal h1 until the next leading edge of the third clock signal f3 is generated so as to generate a second temperature conversion signal h2, an inverter 18*b* for inverting the third clock signal f3 so as to generate a fourth clock signal f4, a register 14*b* for receiving a second temperature conversion signal h2 every time a leading edge of the fourth clock signal f4 is generated and holding the second temperature conversion signal h2 until the next leading edge of the fourth clock signal f4 is generated so as to generate a third temperature conversion signal h3.

The temperature judging circuit 9 further comprises an inverter 18*a* for inverting the first clock signal f1 so as to generate a second clock signal f2, a frequency divider 17*b* for dividing the second clock signal f2 by 2 so as to generate a fifth clock signal f5, a subtracter 16 for calculating a difference between the second temperature conversion signal h2 and the third temperature conversion signal h3 every time a leading edge of the fifth clock signal f5 is generated so as to generate a temperature change signal g, and a comparator 12*c* for receiving the third comparison signal d3, and comparing a third reference signal c3 indicating the maximum temperature change which is able to maintain the predetermined temperature range with the temperature change signal g so as to generate a temperature judging signal e.

In the other embodiment of the present invention, a fourth reference signal c4 is provided in case that the maximum temperature change which is able to maintain the predetermined temperature range when the surface temperature of the heat roller is increased is different from the temperature change which is able to maintain the predetermined temperature range when the surface temperature of the heat roller is decreased, and the third reference signal c3 or the fourth reference signal c4 is compared with the temperature change signal g according to the sign of the temperature change signal g.

Figure 2:
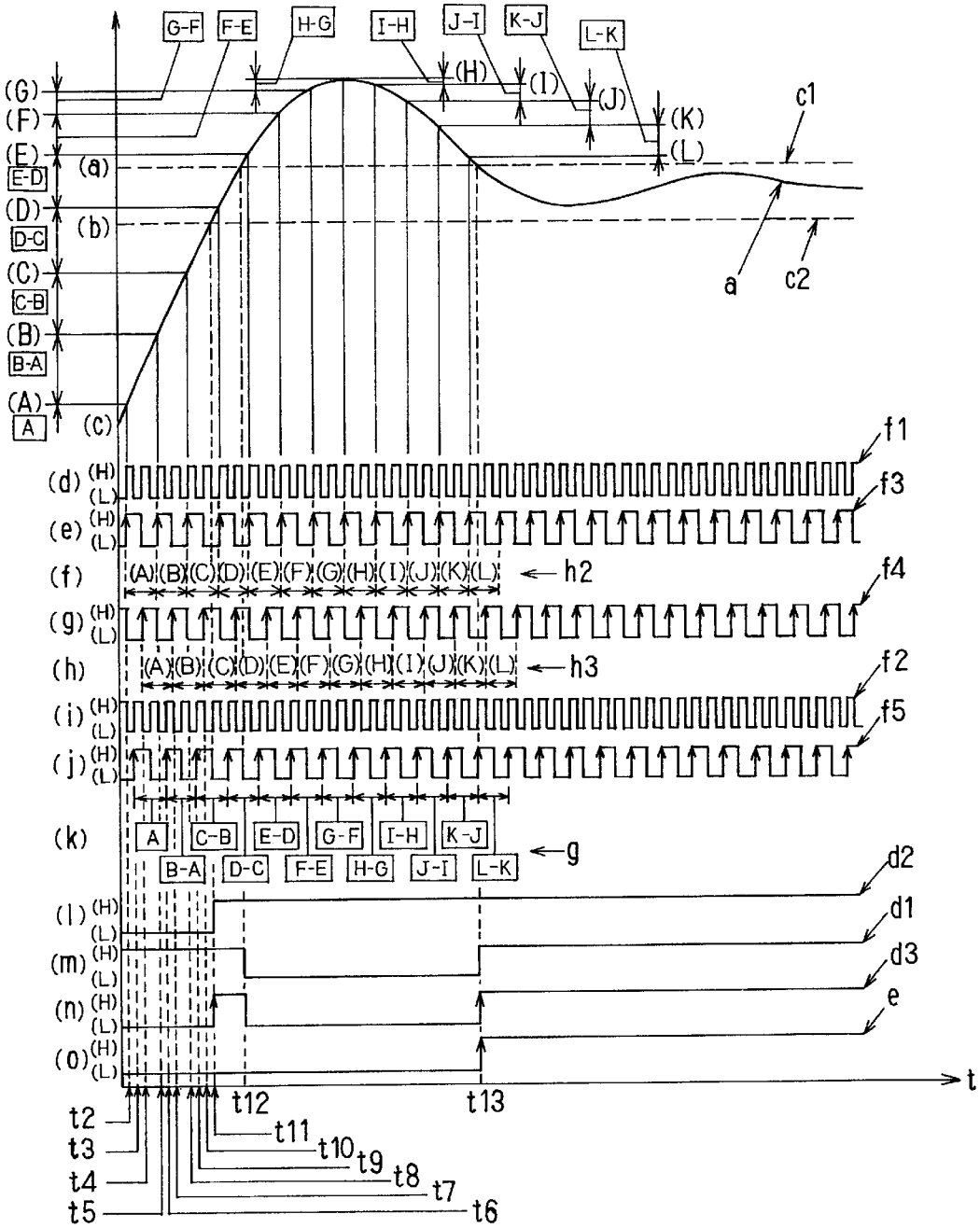
FIG. 2 shows a diagram for explaining the heat roller control apparatus shown in FIG. 1.

FIG. 2 shows a diagram for explaining heat roller control apparatus according to the present invention. In FIG. 2, a reference symbol (a) denotes a predetermined value or a predetermined level of the first reference signal c1 showing the upper limit value of the predetermined temperature range, (b) denotes a predetermined value or a predetermined level of the temperature signal a of the second reference signal c2 showing the lower limit value of the predetermined temperature range, (c) denotes a predetermined value or a predetermined level of the temperature signal a outputted from the temperature detecting element 5, (d) denotes a predetermined value or a predetermined level of the first clock signal f1, (e) denotes a predetermined value or a predetermined level of the third clock signal f3, (f) denotes a value of the second temperature conversion signal h2, (g) denotes a predetermined value or a predetermined level of the fourth clock signal f4, (h) denotes a value of the third temperature conversion signal h3, (i) denotes a predetermined value or a predetermined level of the second clock signal f2, (j) denotes a predetermined value or a predetermined level of the fifth clock signal f5, (k) denotes a value of the temperature conversion signal g, (l) denotes a predetermined value or a predetermined level of the second comparison signal d2, (m) denotes a predetermined value or a predetermined level of the first comparison signal d1, (n) denotes a predetermined value or a predetermined level of the third comparison signal d3, and (o) denotes a predetermined value or a predetermined level of the temperature judging signal e.

The heat roller control apparatus of the present invention will now be explained with reference to FIG. 2.

As shown in (f) of FIG. 2, the register 14*a* receives the first temperature conversion signal h1 obtained by converting the temperature signal a shown in (c) of FIG. 2 by the A/D converter 11 every time the leading edge (L→H) of the third clock signal f3 shown in (e) of FIG. 2 is generated, maintains the first temperature conversion signal h1 until the next leading edge of the third clock signal f3 is generated, and then outputs the second temperature conversion signal h2. For example, the register 14*a* receives a value [A] of the first temperature conversion signal h1, maintains it until a time t5, and then outputs the second temperature conversion signal h2, if the value of the temperature signal a at a time t2 is [A].

Further, the register 14*a* receives a value [B] of the A/D converted first temperature conversion signal h1, maintains until a time t8 and outputs the second temperature conversion signal h2, if the value of the temperature signal a at the time t5 is [B]. The operation of the register 14*a* is repeated every time the leading edge of the third clock signal f3 is generated.

As shown in (h) of FIG. 2, the register 14*b* receives the second temperature conversion signal h2 every time the leading edge (L→H) of the fourth clock signal f4 shown in (g) of FIG. 2 is generated, maintains the second temperature conversion signal h2 until the leading edge of the fourth clock signal f4 is generated, and then outputs the third temperature conversion signal h3. For example, the register 14*b* receives the value [A] of the second temperature conversion signal h2 at a time t4, maintains it until a time t7, and outputs the third temperature conversion signal h3.

Further, the register 14*b* receives the value [B] of the second temperature conversion signal h2 at the time t7, maintains it until a time t10, and then outputs the third temperature conversion signal h3. The operation of the register 14*b* is repeated every time the leading edge of the fourth clock signal f4 is generated.

As shown in (k) of FIG. 2, the subtracter 16 receives the second temperature conversion signal h2 shown in (f) of FIG. 2 and the third temperature conversion signal h3 shown in (h) of FIG. 2 every time the leading edge (L→H) of the fifth clock signal f5 shown in (j) of FIG. 2 is generated, and outputs the temperature change signal g obtained by subtracting the third temperature conversion signal h3 from the second temperature conversion signal h2. The temperature change signal g is maintained until the next leading edge of the fifth clock signal f5 is generated. For example, the subtracter 16 receives the value [A] of the second temperature conversion signal h2 and a value (NONE) of the third temperature conversion signal h3 at a time t3 (the register 14*b* receives no reading date at the time t3), calculates [A]−[NONE]=[A], and outputs [A] as the temperature change signal g until a time t6.

Next, the subtracter 16 receives the value [B] of the second temperature conversion signal h2 and the value [A] of the third temperature conversion signal h3 at the time t6, calculates [B]−[A], and outputs the temperature change signal g until a time t9. The operation of the subtracter 16 is repeated every time the leading edge of the fifth clock signal f5 is generated.

The comparator 12*b* receives the temperature signal a shown in (c) of FIG. 2 and as shown in (l) of FIG. 2, outputs the second comparison signal d2 of "L" if the temperature signal a is smaller than the second reference signal c2 indicating the lower limit value of the predetermined temperature range, or outputs the second comparison signal d2 of "H" if the temperature signal a is higher than the second reference signal c2. For example, the second comparison signal d2 is "L" until a time 11, because the temperature signal a is lower than the second reference signal c2, and is "H" after the time 11, because the temperature signal a is larger than the second reference signal c2.

The comparator 12*a* receives the temperature signal a shown in (c) of FIG. 2, and as shown in (m) of FIG. 2, outputs the first comparison signal d1 of "H" if the temperature signal a is smaller than the first reference signal c1 indicating the upper limit value of the predetermined rage, or outputs the first comparison signal d1 of "L" if the temperature signal a is larger than the first reference signal c1. For example, the first comparison signal d1 is "H" until a time t12, because the temperature signal a is smaller than the first reference c1, and is "L" between the time t12 and a time t13, because the temperature signal a is larger than the first reference signal c1. The first comparison signal d1 is "H" after the time t13, because the temperature signal a is smaller than the first reference signal c1. The AND gate 13 receives the second comparison signal d2 and the first comparison signal d1 shown in (l) and (m) of FIG. 2, respectively, and as shown in (n) of FIG. 2, outputs the third comparison signal d3 of "H" only when the second comparison signal d2 and the first comparison signal d1 are "H", respectively. That is, the temperature signal a is in the predetermined temperature range when the third comparison signal d3 is "H".

The comparator 12*c* compares an absolute value of the temperature change signal g shown in (k) of FIG. 2 with the third reference signal c3 showing the maximum value of temperature change for maintaining the predetermined temperature range ever time the leading edge (L→H) of the third comparison signal d3 shown in (n) of FIG. 2 is generated, and as shown in (o) of FIG. 2, outputs the temperature judging signal e of "L" when the temperature change signal g is larger than the third reference signal c3, and outputs the temperature judging signal e of "H" when the temperature change signal g is smaller than the third reference signal c3. The fourth reference signal c4 other than the third reference signal c3 is provided in case that the maximum value of temperature change for maintaining the predetermined temperature range when the surface temperature of the heat roller is increased is different from that when the surface temperature is decreased. The maximum value of temperature change for maintaining the predetermined temperature range is set to the third reference signal c3 when the surface temperature of the heat roller is increased, and set to the fourth reference signal c4 when the surface temperature of the heat roller is decreased. The third reference signal c3 is compared with the temperature change signal g when the temperature change signal g is "+" (the surface temperature of the heat roller is increased), and the fourth reference signal c4 is compared with the temperature change signal g when the temperature change signal g is "−" (the surface temperature of the heat roller is decreased ). For example, the comparator 12*c* compares the value "C−B" of the temperature change signal g shown in (k) of FIG. 2 with the third reference signal c3 at the time t11, and outputs the temperature judging signal e of "L" if (C−B)>the third reference signal c3. Further, the comparator 12*c* compares the value (L−K) of the temperature change signal g shown in (k) of FIG. 2 with the fourth reference signal c4 at the time t13, and outputs the temperature judging signal e of "H" if (L−K )<the fourth reference signal c4.

The present invention provides important advantages over the conventional heat roller control apparatus. For example, according to the heat roller control apparatus of the present invention, an interval between a time at which the surface temperature of the heat roller reaches into the predetermined temperature range and a time at which the member 1A and the thin film 1B are allowed to transfer can be shortened by changing the temperature judging signal from "L" to "H" quickly (within ½f, where f is the clock frequency of the oscillator ) after the surface temperature of the heat roller has reached into the predetermined temperature range.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. A heat roller control apparatus comprising: a heat roller for hot melt coating a thin film on a member, a heater for heating the heat roller, temperature detecting means for detecting the surface temperature of the heat roller, temperature control means for controlling the heater according to a temperature detecting signal obtained from the temperature detecting means, and temperature judging means for producing a temperature judging signal for judging the state of the surface temperature of the heat roller according to the temperature detecting signal, wherein the member to be attached with the thin film is transferred only when the surface temperature reaches into a predetermined temperature range and a variation of the surface temperature of the heat roller is smaller than a predetermined value.

2. The heat roller control apparatus as claimed in claim 1, wherein the temperature judging means comprising: a circuit comprising an A/D converter, three comparators, an AND gate, two registers, an oscillator, a subtracter, two frequency dividers, and two inverters.

3. A heat roller control apparatus comprising: a heat roller for hot melt coating a thin film on a member, a heater for heating the heat roller, temperature detecting means for detecting the surface temperature of the heat roller, temperature control means for controlling the heater according to a temperature detecting signal obtained from the temperature detecting means, and temperature judging means for producing a temperature judging signal for judging the state of the surface temperature of the heat roller according to the temperature detecting signal, wherein the temperature judging means is a circuit comprising an A/D converter, three comparators, an AND gate, two registers, an oscillator, a subtracter, two frequency dividers, and two inverters, and wherein the temperature judging means calculates a variation of the surface temperature of the heat roller from the temperature detecting signal every predetermined time and judging the stability of the hot melt coating by the variation of the surface temperature of the heat roller when the temperature detecting signal reaches into a predetermined temperature range.

* * * * *